US007969376B2

(12) United States Patent
Steghafner et al.

(10) Patent No.: US 7,969,376 B2
(45) Date of Patent: Jun. 28, 2011

(54) HORN ANTENNA

(75) Inventors: Herbert Steghafner, Tiefenbach (DE); Dietmar Leugner, Munich (DE); Berthold Klos, Ottobrunn (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 489 days.

(21) Appl. No.: 12/234,576

(22) Filed: Sep. 19, 2008

(65) Prior Publication Data

US 2009/0079649 A1 Mar. 26, 2009

(30) Foreign Application Priority Data

Sep. 20, 2007 (DE) ..... 10 2007 044 895

(51) Int. Cl.
*H01Q 13/10* (2006.01)

(52) U.S. Cl. ..... 343/786; 343/772; 343/773

(58) Field of Classification Search ..... 343/772, 343/773, 786, 767, 771
See application file for complete search history.

(56) References Cited

U.S. PATENT DOCUMENTS

| | | | | |
|---|---|---|---|---|
| 6,348,898 | B1 * | 2/2002 | Rosenbury et al. | 343/786 |
| 6,667,721 | B1 * | 12/2003 | Simonds | 343/773 |
| 6,995,728 | B2 | 2/2006 | Rodriguez | |
| 2003/0210197 | A1 * | 11/2003 | Cencich et al. | 343/786 |
| 2005/0231436 | A1 * | 10/2005 | McLean et al. | 343/786 |

OTHER PUBLICATIONS

Liu, W., and X. XI, "Design and Simulation of TEM Double Ridge Guide Horn Antenna," Proceedings of the 8th International Conference on Electronic Measurement and Instruments (ICEMI'2007), Xi'an, China, Aug. 16-18, 2007, pp. 1-703-1-706.

* cited by examiner

*Primary Examiner* — Douglas W Owens
*Assistant Examiner* — Dieu T Duong
(74) *Attorney, Agent, or Firm* — Christensen O'Connor Johnson Kindness PLLC

(57) ABSTRACT

The invention relates to an antenna (1) for a transmitting operation and/or a receiving operation with a decoupling apparatus (2*a*) and/or a coupling apparatus (2*b*) for electromagnetic waves. The antenna (1) according to the invention comprises a horn funnel (4) which is composed of at least two side walls (3*a*, 3*b*, 3*c*, 3*d*), and also comprises at least two fins (5*a*, 5*b*) which extend into the interior of said horn funnel (4). The at least two side walls (3*a*, 3*b*, 3*c*, 3*d*) have a cutout (7*a*, 7*b*) in each case.

31 Claims, 9 Drawing Sheets

State of the art

HORN ANTENNA

FIELD OF INVENTION

The invention relates to a horn antenna for transmitting and receiving electromagnetic waves in the frequency range from, for example, about 1 GHz to about 18 GHz.

BACKGROUND

U.S. Pat. No. 6,995,728 B2 describes a horn antenna with a pyramid-shaped horn funnel and a ridge. Said horn antenna comprises a first and a second conducting wall, which walls are disposed so as to form an angle in relation to one another. The horn antenna also has a first ridge in the vicinity of the first conducting wall and a second ridge in the vicinity of the second conducting wall, the first ridge extending over the averted end of the first wall and the second ridge extending over the averted end of the second wall. The curvature of the first ridge corresponds to an arc which is tangent to a line that is perpendicularly upright on the surface of the first wall.

The disadvantage of the horn antenna described in U.S. Pat. No. 6,995,728 B2 lies in the fact that the antenna gain is subject to major fluctuations, particularly at low frequencies. Furthermore, the antenna gain drops to less than 0 dBi at low frequencies, such as frequencies around 1 GHz for example.

A further disadvantage of this horn antenna consists in the fact that the voltage standing wave ratio in the lower frequency range is very unfavorable, with values of between 2 and 5, since it is scarcely possible to operate the horn antenna from a VSWR of about 3.

BRIEF SUMMARY

The underlying object of the invention is to indicate an antenna which has a good antenna gain without fluctuations at low frequencies and which has a lower VSWR, even in the lower frequency range.

The aforesaid object is achieved, according to the invention, by means of the features in the pre-characterizing clause of claim 1, in combination with the characterizing features. Advantageous further developments form the subject of the subclaims which are referred back to these.

The antenna according to the invention for a transmitting operation and/or a receiving operation thus comprises a coupling apparatus and/or a decoupling apparatus for electromagnetic waves. Provided around said coupling or decoupling apparatus is a horn funnel which is composed of at least two side walls and comprises at least two fins, the coupling apparatus and/or decoupling apparatus being preferably provided at a narrow end of said horn funnel. The fins of the antenna according to the invention are disposed substantially inside the horn funnel, the at least two side walls having two cutouts which are preferably trapezoidal in each case.

One advantage consists particularly in the fact that the two cutouts are congruent, a fact which reduces the expenditure on production when manufacturing the incised side walls.

In addition to this, the two side walls preferably have the same tolerances, so that no asymmetries are produced in the radiating characteristic of the antenna according to the invention as a result of different tolerances in the material of the antenna.

It is also advantageous that the two cutouts are disposed substantially symmetrically in relation to one another, a fact which, once again, has a favorable effect on a radiating characteristic of the antenna according to the invention that is as symmetrical as possible.

Furthermore, it is advantageous if each trapezoidal cutout has a longitudinal axis of symmetry in each case. The side walls having the cutout are thereby easier to position, since the said longitudinal axis of symmetry can be oriented in a simple manner and with a high degree of accuracy at a specific angle to the coupling or decoupling apparatus.

In addition, it is of advantage if one direction component, in each case, of one fin, in each case, is oriented parallel to the longitudinal axis of symmetry. This ensures precise adjustment of the fins, relative to the coupling or decoupling apparatus.

In addition to this, it is of advantage if the two fins of the antenna according to the invention are disposed symmetrically within the horn funnel and extend through the cutout, so that, in each case, a first part, which is smaller in terms of area, of the two fins projects, in each case, beyond the side wall that forms the horn funnel.

In each case, a second part, which is larger in terms of area, of the two fins advantageously projects into the horn funnel in each case, so that even electromagnetic waves with a high frequency can be conducted inside said horn funnel, since the electrical field develops, above all, between the two fins, in the event of excitation with a high frequency.

A further advantage is obtained if the two fins each have a rounded-off end in the direction of a broad opening of the horn funnel, so that the boundary conditions for the profile of the fields are constant.

In addition to this, it is of advantage that the radiation diagram of the antenna according to the invention has no breakdown. This guarantees uniform illumination of a test specimen when the antenna according to the invention is used, for example, as a measuring antenna in an EMC (electromagnetic compatibility) laboratory.

In addition, it is of advantage if the profile of the antenna gain in dependence upon the frequency is relatively smooth. The user of the antenna according to the invention is thereby able to estimate or calculate the field strengths more easily.

BRIEF DESCRIPTION OF THE DRAWINGS

Exemplified embodiments of the present antenna according to the invention will be described below. Both the structure and also the mode of operation of the horn antenna, and also its other advantages, can be best understood with the aid of the following description, in conjunction with the appertaining drawings, in which.

DETAILED DESCRIPTION

In all the figures, parts that correspond to one another are provided with the same reference symbols.

Figure 1:
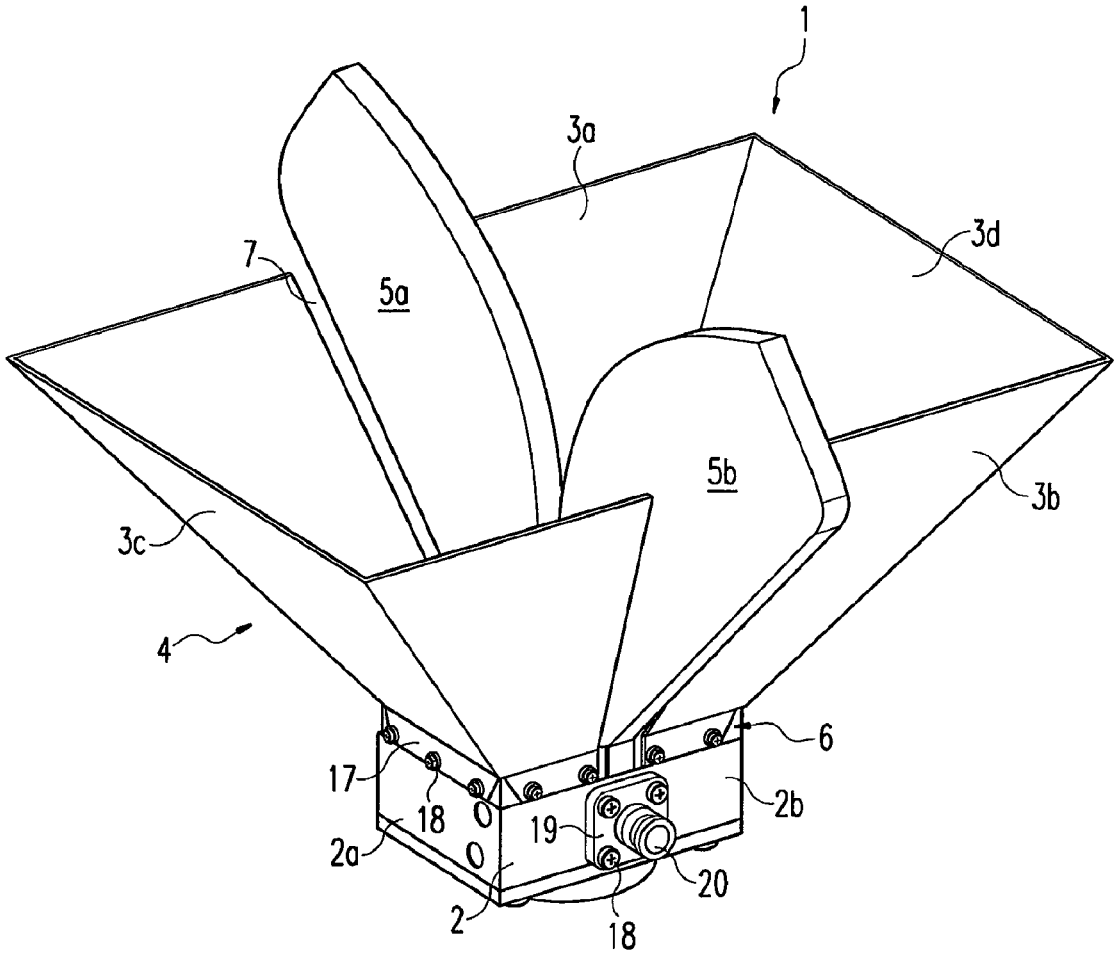
FIG. 1 shows a side view, in perspective, of a first exemplified embodiment of the antenna according to the invention, from above.

FIG. 1 shows a side view, in perspective, of a first exemplified embodiment of the antenna 1 according to the invention, from above. The horn funnel 4 of the antenna 1 according to the invention consists of four side walls 3*a*, 3*b*, 3*c*, 3*d*, two opposed side walls 3*a*, 3*b* each having a cutout 7*a*, 7*b* through which one of the two fins 5*a*, 5*b* extends in each case. Disposed at the narrow end 6 of the horn funnel 4, which funnel is dimensioned, above all, as a reflector at lower frequencies, is the decoupling or coupling apparatus 2*a*, 2*b*, the side walls 3*a*, 3*b*, 3*c*, 3*d* being fastened thereto via a folded edge 17 by means of a number of screws 18 or rivets. In this first exemplified embodiment, the decoupling apparatus 2*a* and the coupling apparatus 2*b* are integrated in an overall casing 2. A flange 19 with a coaxial plug 20 is fastened, preferably by means of screws 18, to a side wall of the decoupling or coupling apparatus 2*a*, 2*b*. This coaxial plug 20 serves to feed in high-frequency electromagnetic waves via a coaxial cable, or to conduct out, via said coaxial cable, high-frequency electromagnetic waves that have been received. A matching circuit may also be accommodated in the casing 2, so that the horn antenna 1 according to the invention can be operated at very much lower frequencies in spite of an unfavorable VSWR with values between 2 and 3.

Figure 2:
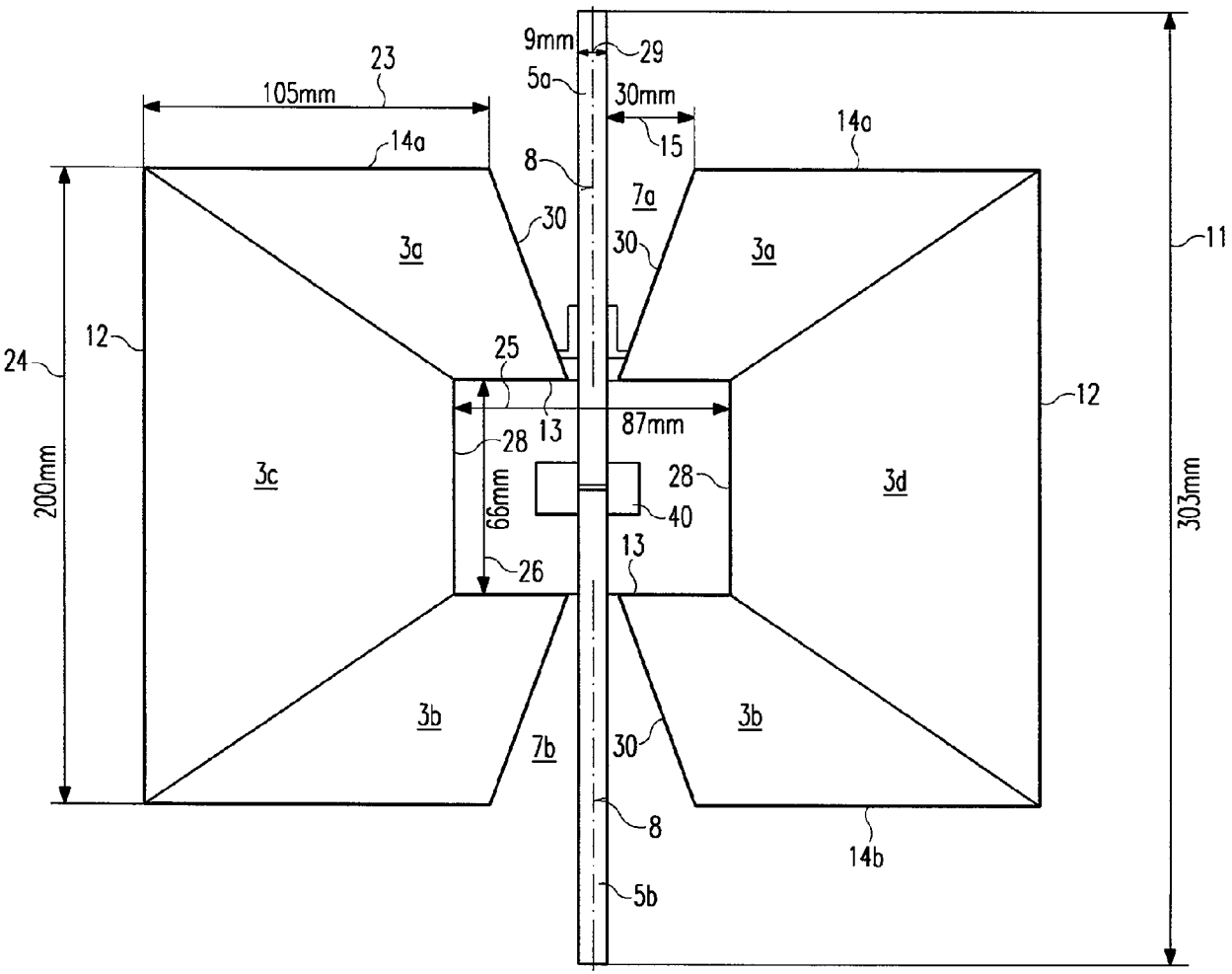
FIG. 2 shows a front view of the exemplified embodiment of the antenna according to the invention, with the preferred dimensions.

FIG. 2 shows a front view of the first exemplified embodiment of the antenna 1 according to the invention, with the preferred dimensions. The two fins 5*a*, 5*b* together have a maximum overall length 11 within the range from 200 mm to 400 mm for example, and preferably, in the exemplified embodiment, an overall length 11 of about 303 mm.

A broad edge 14*a*, 14*b* of a first side wall 3*a* and a second side wall 3*b* at an opening 10 of the horn funnel 4 has a length 23 within the range from 50 mm to 150 mm for example, and preferably, in the exemplified embodiment, a length of about 105 mm, and delimits the cutout 7*a*.

A broad edge 12 of a third side wall 3*c* and a fourth side wall 3*d* at an opening 10 of the horn funnel 4 has a length 24 within the range from 50 mm to 150 mm for example, and preferably, in the exemplified embodiment, a length of 100 mm.

A length of the decoupling apparatus 2*a* or of the coupling apparatus 2*b* that corresponds to the overall length 25 of a narrow edge 13 of the first side wall 3*a* and of the second side wall 3*b* at the narrow end 6 of the horn funnel 4, lies within the range from 50 mm to 150 mm, for example, the length which is preferred in the exemplified embodiment being about 87 mm.

Each cutout 7*a*, 7*b*, which is substantially trapezoidal in the exemplified embodiment, has a longitudinal axis of symmetry 8 in each case, so that symmetrical fastening of the side walls 3*a*, 3*b* to the decoupling or coupling apparatus 2*a*, 2*b* is easily possible.

A length of the decoupling apparatus 2*a* or of the coupling apparatus 2*b* that corresponds to the overall length 26 of a narrow edge 28 of the third side wall 3*c* and of the fourth side wall 3*d* at the narrow end 6 of the horn funnel 4, lies within the range from 50 mm to 100 mm, for example, the preferred length in the exemplified embodiment being about 66 mm.

The distance 15 of the two fins 5*a*, 5*b* from, in each case, an edge 30 of a first and second side wall 3*a*, 3*b* respectively, at the outermost rim of the opening 10 of the horn funnel 4 lies, for example, within the range from 25 mm to 35 mm, the distance which is preferred in the exemplified embodiment being about 30 mm.

A thickness 29 of the fins 5*a*, 5*b* lies, for example, in the range between 5 mm and 15 mm, the thickness or the gauge of material which is preferred in the exemplified embodiment being about 9 mm.

An absorber 40, which is made, for example, of a carbon-containing foam material and which damps the reflections of the electromagnetic radiation radiated or received, is preferably located in the center of the narrow end 6 of the horn funnel 4, or inside the casing 2 disposed thereon.

Figure 3:
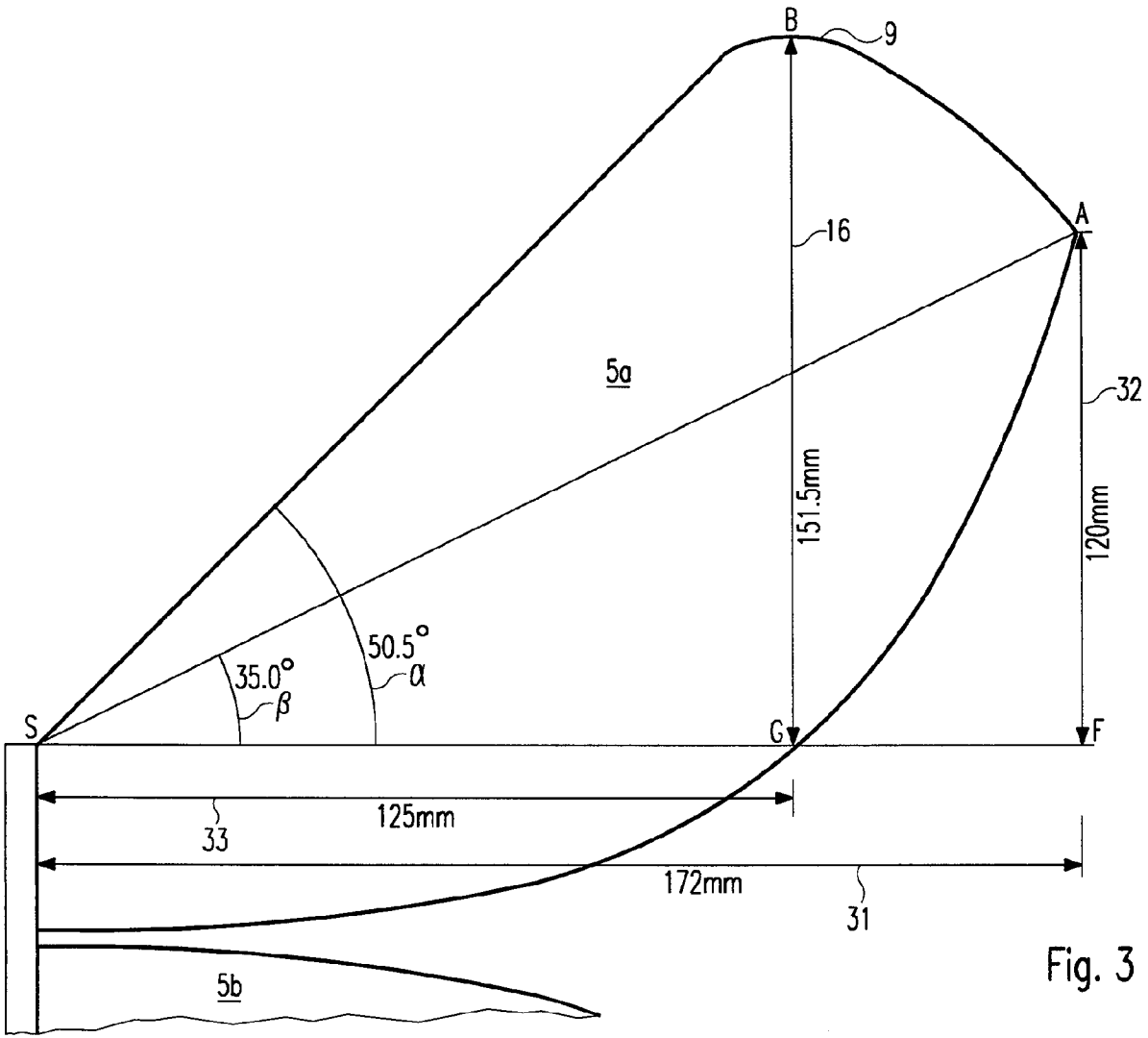
FIG. 3 shows a side view of one fin of the exemplified embodiment of the antenna according to the invention, and the essential preferred dimensions.

FIG. 3 shows a side view of a fin 5*a* of the antenna 1 according to the invention, and its essential preferred dimensions. The overall length 31 of a fin 5*a*, which corresponds to the length of the section SF, lies within the range from 150 mm to 200 mm for example, but is preferably 172 mm. The first height 16 of the fin 5*a*, which corresponds to the section GB, lies within the range from 100 mm to 200 mm, but the height 16 which is preferred in the exemplified embodiment is about 151.5 mm, the point B lying at a rounded-off end 9 of said fin 5*a*. The distance 32 of the point A from the point F, which distance corresponds to a second height 32 of the fin 5*a*, lies within the range from 100 mm to 150 mm for example, the preferred length being about 120 mm. The angle $\alpha$ about the vertex S lies within the range 45° to 55° for example, the preferred angle in the exemplified embodiment being about 50.5°. The angle $\beta$ about the vertex S lies within the range 30° to 40°, the preferred angle in the exemplified embodiment being about 35°. The section SG, which corresponds to a boundary section 33 of the fin 5*a*, has a length which lies within the range from 100 mm to 150 mm for example. Its length which is preferred in the exemplified embodiment is about 125 mm.

Figures 4, 5:
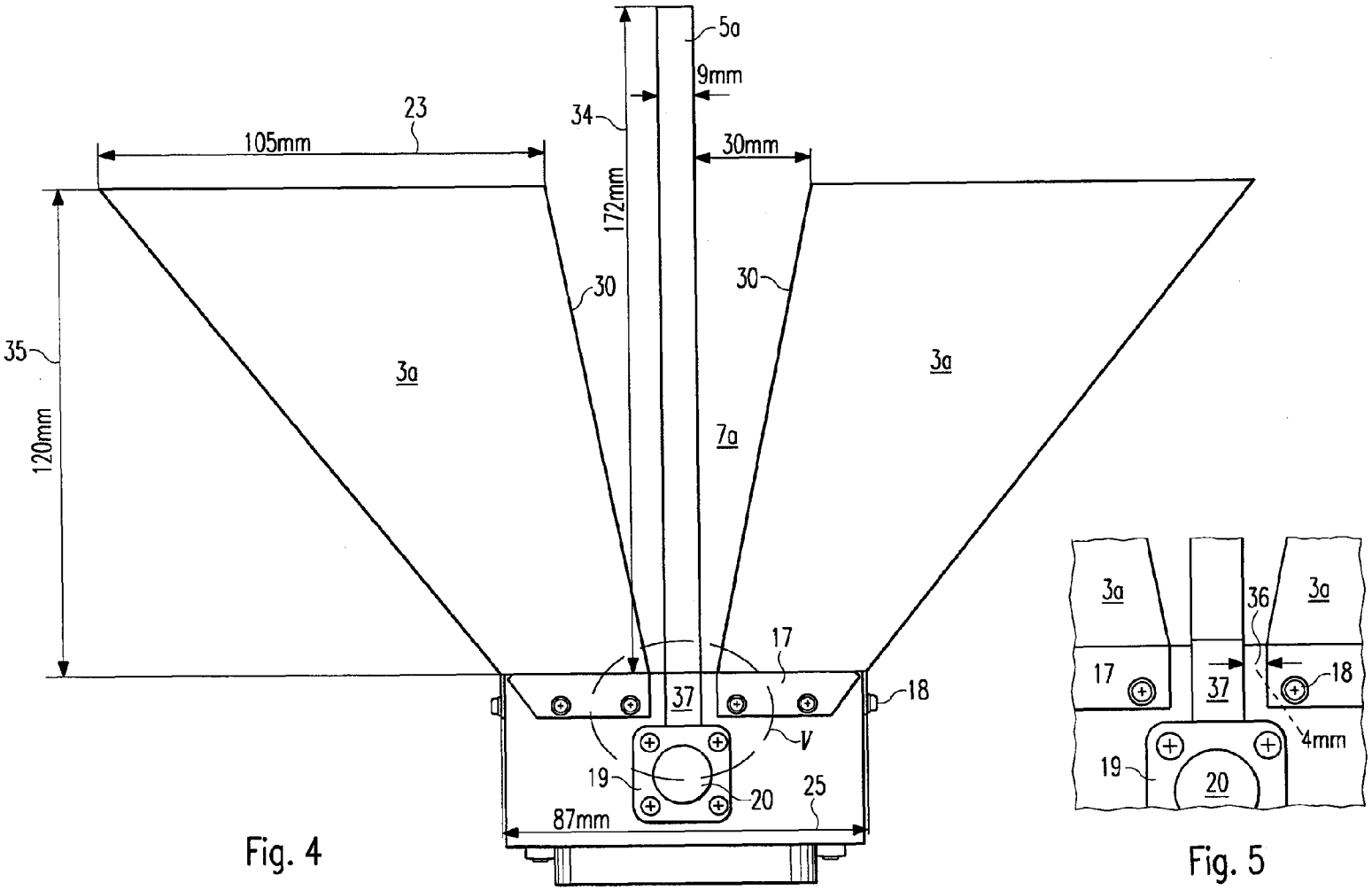
FIG. 4 shows a plan view of one side wall of the antenna according to the invention, with a cutout and the preferred dimensions.
FIG. 5 shows, in an enlarged representation, a region which is marked by V in FIG. 4.

FIG. 4 shows a plan view, onto the antenna, of a first side wall 3*a* with a cutout 7*a*, and also shows the preferred dimensions of the antenna 1 according to the invention, a third height 34 of the fin 5*a* with respect to a base region 37 of the coupling or decoupling apparatus 2*a*, 2*b* lying within a range from 150 mm to 200 mm for example, and preferably being about 172 mm in the exemplified embodiment. The height 35 of the horn funnel 4 in the longitudinal direction of the antenna lies within a range from 100 mm to 150 mm for example, the height which is preferred in the exemplified embodiment being about 120 mm. Moreover, it can be inferred, from FIG. 4 as well as from FIG. 2, that the horn funnel 4, and in particular its lateral edge 30, is at an increasing distance from the fin 5*a*, 5*b*. In the exemplified embodiment, this distance lies in the region of about 4 mm in the base region 37 of the fin 5*a*, 5*b* and about 30 mm at the rim of the opening 10 of the horn funnel 4.

FIG. 5 shows, in an enlarged representation, a region which is marked by V in FIG. 4. The distance 36 of the folded edge 17 for fastening the side walls 3*a*, 3*b*, 3*c*, 3*d*, and in particular the first side wall 3*a* and second side wall 3*b* of the horn funnel 4, from the base region 37 of the fin 5*a* lies, for example, within the range from 2 mm to 6 mm in each case, the distance which is preferred in the exemplified embodiment being about 4 mm.

Figure 6:
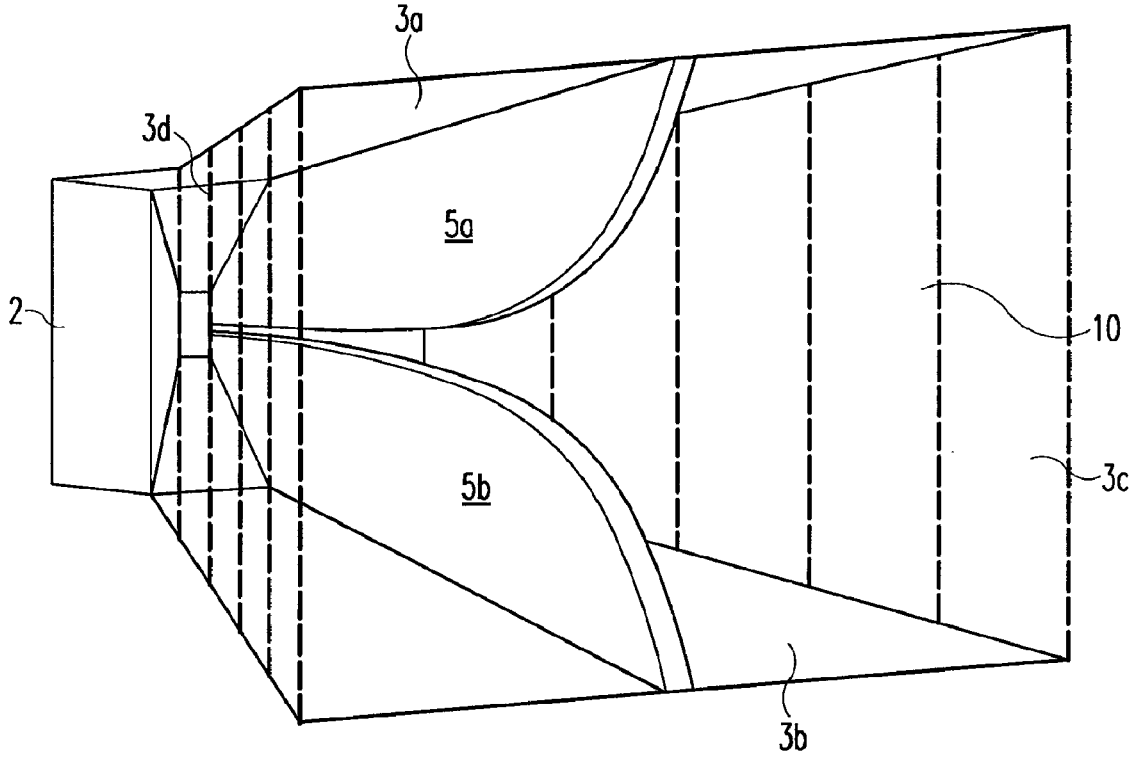
FIG. 6 shows an antenna according to the prior art, without a cutout.

FIG. 6 shows an antenna according to the prior art without a cutout in the region of the two fins 5*a*, 5*b*, the connecting bars 3*c*, 3*d* being optional. It can be clearly seen that the two fins 5*a*, 5*b* do not project beyond the side walls 3*a*, 3*b*. Furthermore, the ends of the two fins 5*a*, 5*b* terminate with the opening 10 of the horn funnel 4.

Figure 7:
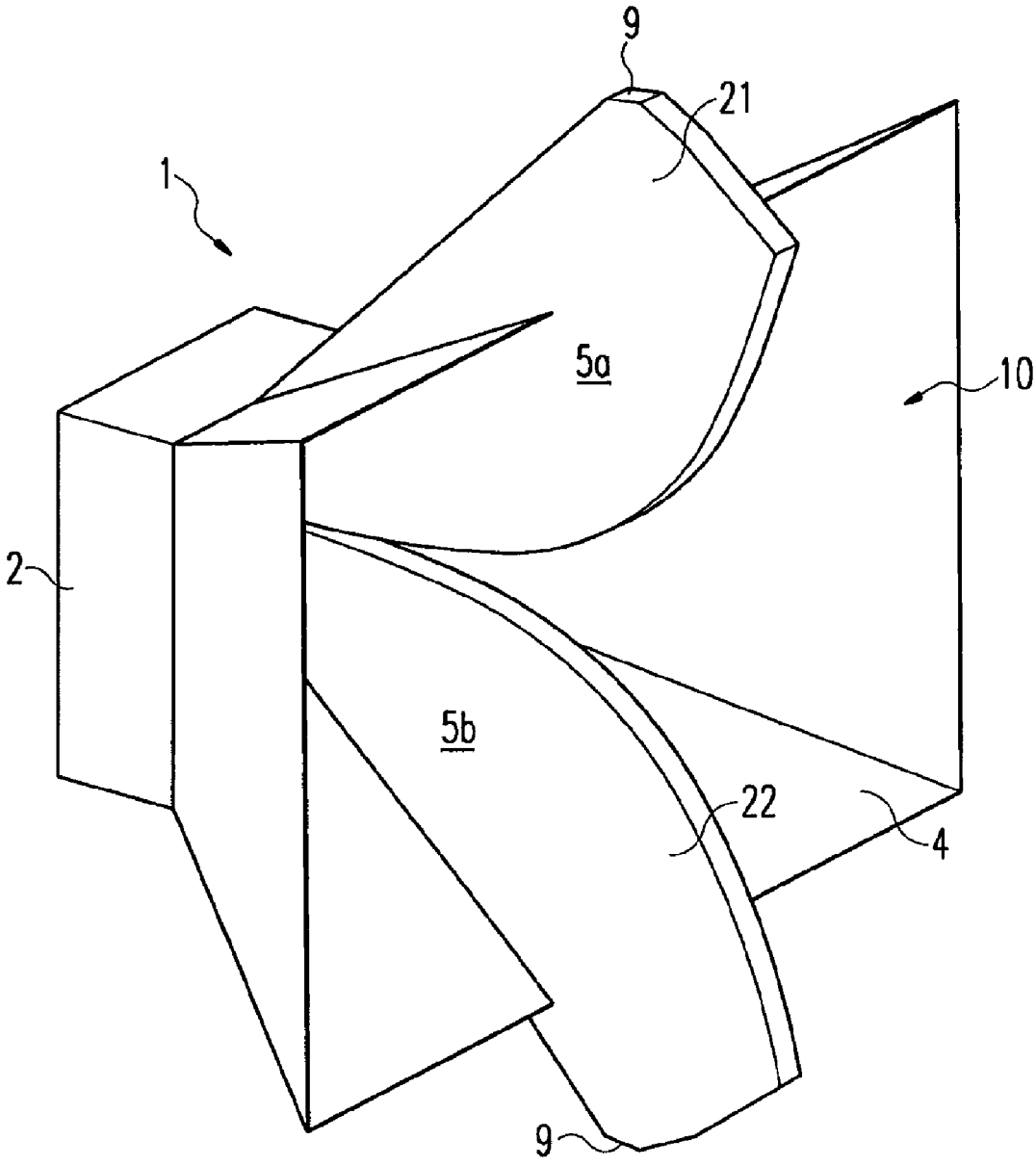
FIG. 7 shows a frontal view, in perspective, of a second exemplified embodiment of the antenna according to the invention.

FIG. 7 shows a frontal view, in perspective, of a second exemplified embodiment of the antenna 1 according to the invention with a cutout 7*a*, 7*b* in each of the two side walls 3*a*, 3*b*, the measurements of the area of said cutout 7*a*, 7*b* being such, in each case, that the two fins 5*a*, 5*b* are able to project beyond the said side walls 3*a*, 3*b*.

A first part 21 of the two fins 5*a*, 5*b* which is smaller in each case, area-wise, projects beyond the side walls 3*a*, 3*b*, in each case, that form the horn funnel 4. A second part 22 of said two fins 5*a*, 5*b* which is larger, area-wise, is disposed inside the horn funnel 4 in each case.

Figure 8A:
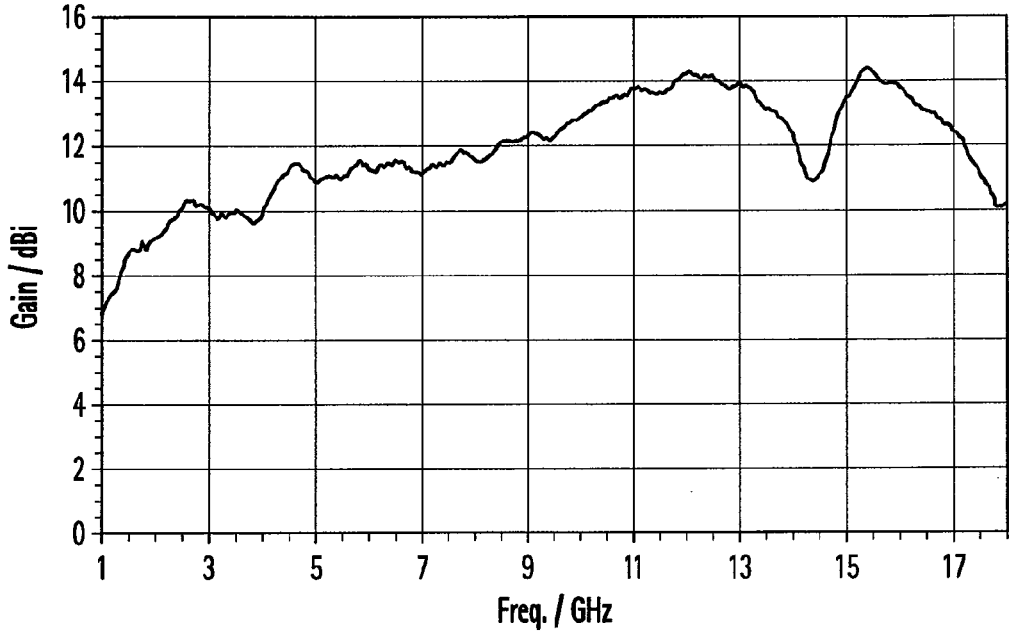
FIG. 8*a* shows a profile of the antenna gain in dependence upon the frequency used, in the case of a conventional antenna.

FIG. 8*a* shows a profile of the antenna gain (in dB) in dependence upon the frequency used (in GHz), in the case of a conventional antenna according to FIG. 6. It can be clearly seen that the antenna gain breaks down at an operating frequency between 14 GHz and 15 GHz.

Figure 8B:
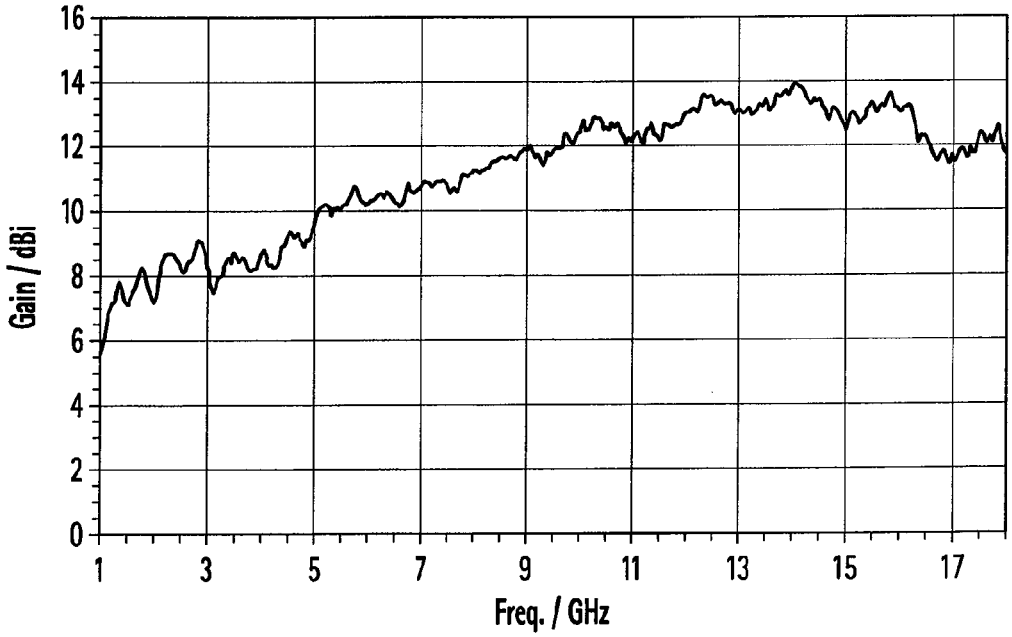
FIG. 8*b* shows a profile of the antenna gain in dependence upon the frequency used, in the case of one exemplified embodiment of the antenna according to the invention.

FIG. 8*b* shows a profile of the antenna gain (in dB) in dependence upon the frequency used (in GHz), in the case of an exemplified embodiment of the antenna according to the invention, the said profile displaying no breakdown in the abovementioned frequency range. In addition to this, it can be seen that the profile of this curve is subject to only minor fluctuations, so that the said curve extends in a smoother manner, compared to the curve shown in FIG. 8*a*.

Figure 9A:
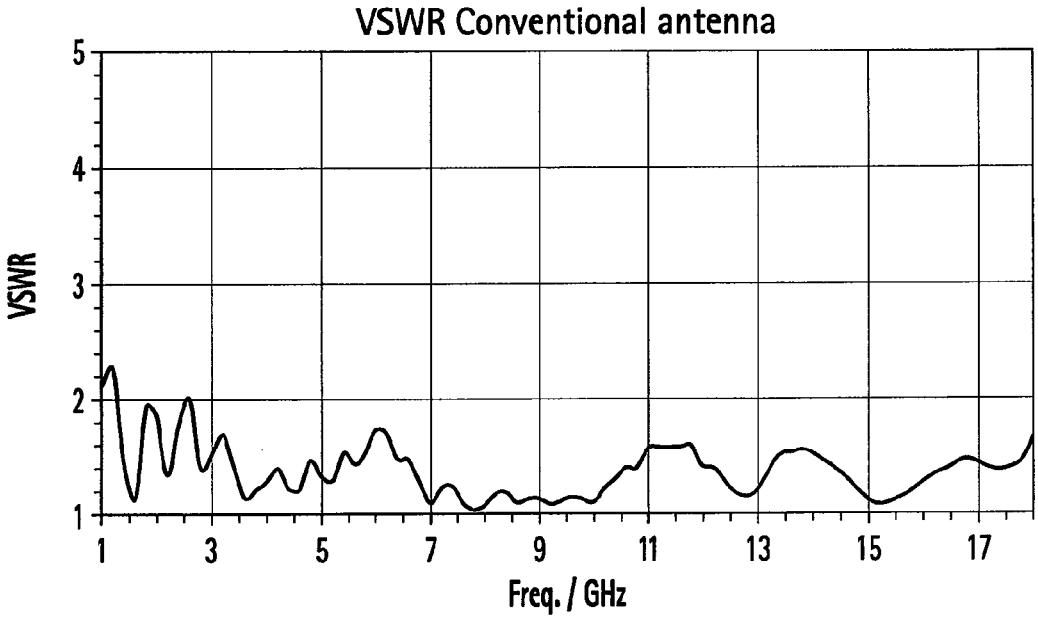
FIG. 9*a* shows a profile of the VSWR (voltage standing wave ratio) in dependence upon the frequency used, in the case of a conventional antenna.
Figure 9B:
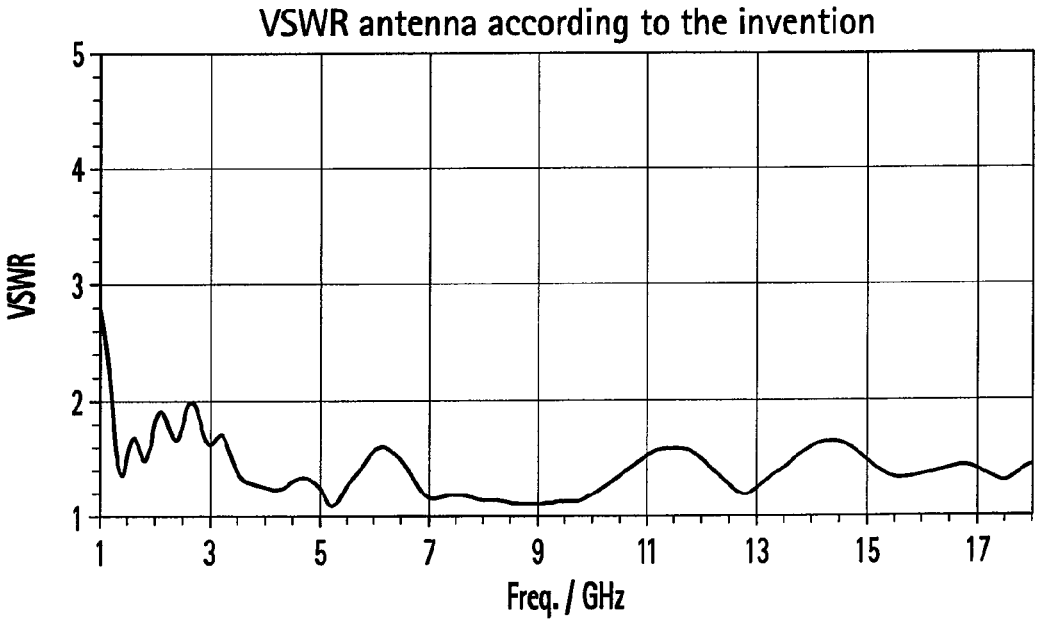
FIG. 9*b* shows a profile of the VSWR (voltage standing wave ratio) in dependence upon the frequency used, in the case of one exemplified embodiment of the antenna according to the invention.

FIG. 9*a* shows a profile of the VSWR (voltage standing wave ratio) in dependence upon the frequency used, in the case of a conventional antenna according to FIG. 6, and FIG. 9*b* shows a profile of the VSWR (voltage standing wave ratio) in dependence upon the frequency used, in the case of an exemplified embodiment of the antenna according to the invention. It can be clearly seen that the antenna according to the invention has a more favorable standing wave ratio in the frequency range from 1 GHz to about 5 GHz. This guarantees that the antenna according to the invention can be operated with greater efficiency in this frequency range.

Figure 10A:
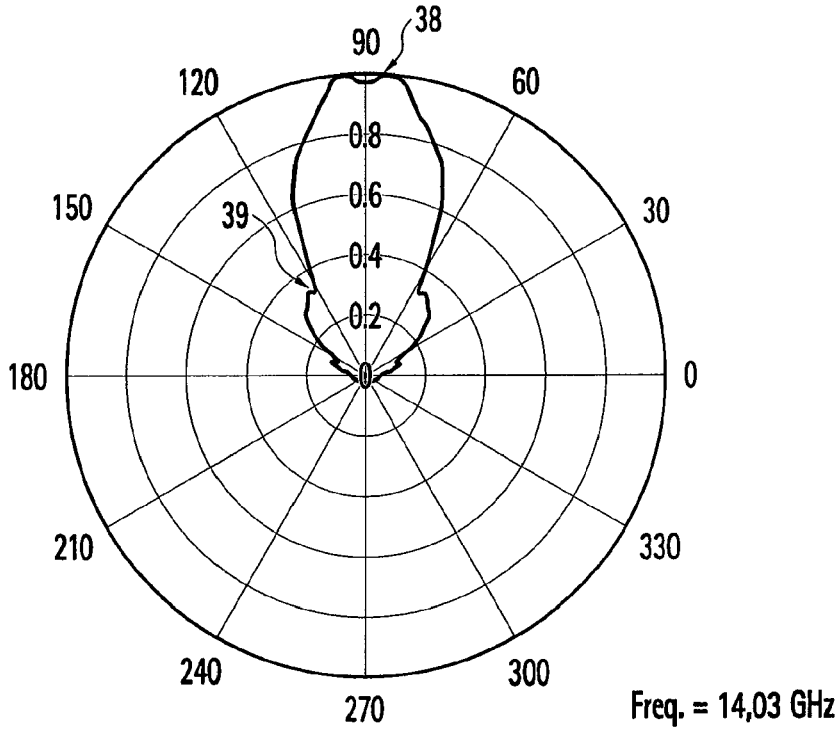
FIG. 10*a* shows a radiation diagram of an antenna according to the invention at a frequency of 14.03 GHz.

FIG. 10*a* shows a radiation diagram of an antenna according to the invention at a frequency of 14.03 GHz. Under these circumstances, only a slight breakdown 38 in the intensity distribution 39 of the electrical field can be seen at 90°. This represents a marked improvement compared to the prior art, since this breakdown 38 is more markedly pronounced in the case of a conventional antenna according to FIG. 6, in the case of which it can be several dB.

Figure 10B:
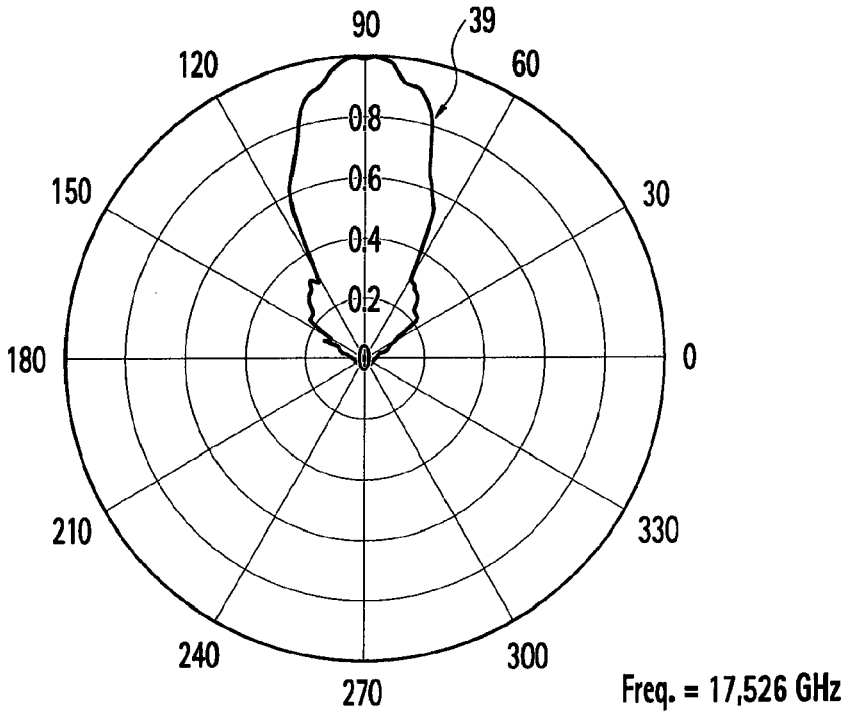
FIG. 10*b* shows a radiation diagram of an antenna according to the invention at a frequency of 17.526 GHz.

FIG. 10*b* shows a radiation diagram of an antenna according to the invention at a frequency of 17.526 GHz. The breakdown 38 shown in FIG. 10*a* scarcely remains pronounced in the intensity distribution 39 of the electrical field in this radiation diagram.

The invention is not restricted to the exemplified embodiments represented in the drawings, and particularly not to an antenna in a laboratory operation. All the features described above and/or represented in the drawings can be combined with one another in any desired manner.

We claim:

1. An antenna for a transmitting operation and/or a receiving operation with a decoupling apparatus and/or a coupling apparatus for electromagnetic waves, comprising:

a horn funnel formed with at least two side walls, and at least two fins that extend into the interior of said horn funnel, wherein at least two cutouts are formed between opposing side edges of the at least two side walls and wherein at least a portion of the fins extends outside of the horn funnel laterally through the cutouts and axially above an upper edge of the at least two side walls.

2. The antenna according to claim 1, wherein the two cutouts are substantially trapezoidal.

3. The antenna according to claim 2, wherein each substantially trapezoidal cutout has a longitudinal axis of symmetry in each case.

4. The antenna according to claim 3, wherein a direction component of a fin, in each case, is oriented approximately parallel to the longitudinal axis of symmetry.

5. The antenna according to claim 1, wherein the two cutouts are disposed substantially symmetrically in relation to one another on two opposed side walls.

6. The antenna according to claim 5, wherein the two cutouts are substantially congruent.

7. The antenna according to claim 1, wherein the two fins are disposed symmetrically in the horn funnel and extend through the cutout in each case.

8. The antenna according to claim 1, wherein a first part of the two fins which is smaller in each case, area-wise, projects beyond a side wall, in each case, that forms the horn funnel.

9. The antenna according to claim 8, wherein a second part of the two fins which is larger in each case, area-wise, is disposed inside the horn funnel in each case.

10. The antenna according to claim 1, wherein the two fins each have a rounded-off end.

11. The antenna according to claim 10, wherein the rounded-off end of the two fins is oriented, in each case, in the direction of a broad opening of the horn funnel.

12. The antenna according to claim 11, wherein the two fins project, with their rounded-off end in each case, beyond the broad opening of the horn funnel.

13. The antenna according to claim 1, wherein the horn funnel is coated to act as a reflector for electromagnetic waves.

14. The antenna according to claim 13, wherein a coating on the horn funnel comprises metal.

15. The antenna according to claim 1, wherein the decoupling apparatus and/or the coupling apparatus is/are attached to a narrow end of the horn funnel.

16. The antenna according to claim 1, wherein the two fins together have a maximum overall length within a range from 200 mm to 400 mm.

17. The antenna according to claim 1, wherein a broad edge of a first side wall having a first cutout and a broad edge of a second side wall having a second cutout has a length within a range from 50 mm to 150 mm, at an opening of the horn funnel.

18. The antenna according to claim 17, wherein a broad edge of a third side wall and a broad edge of a fourth side wall has a length within a range from 50 mm to 150 mm, in each case, at the opening of the horn funnel.

19. The antenna according to claim 1, wherein a length of the decoupling apparatus or of the coupling apparatus that corresponds to the overall length of a narrow edge of a first side wall having a first cutout and a narrow edge of a second side wall having a second cutout has a length within a range from 50 mm to 150 mm, in each case, at a narrow end of the horn funnel.

20. The antenna according to claim 19, wherein a length of the decoupling apparatus or of the coupling apparatus that corresponds to the overall length of a narrow edge of a third side wall and of a fourth side wall at the narrow end of the horn funnel lies within a range from 50 mm to 100 mm.

21. The antenna according to claim 1, wherein the two fins have a thickness within a range from 5 mm to 15 mm.

22. The antenna according to claim 1, wherein a distance of the two fins from an edge of a first side wall or of a second side wall, in each case, lies within a range from 25 mm to 35 mm.

23. The antenna according to claim 1, wherein an overall length of a fin, in each case, lies within a range from 150 mm to 200 mm.

24. The antenna according to claim 1, wherein a first height of a fin lies within the range from 100 mm to 200 mm.

25. The antenna according to claim 24, wherein a second height of the fin that corresponds to a distance of a first boundary point from a second boundary point lies within a range from 100 mm to 150 mm.

26. The antenna according to claim 1, wherein an angle $\alpha$ around a vertex of each fin lies within a range from 45° to 55°.

27. The antenna according to claim 26, wherein an angle $\beta$ about the vertex of each fin lies within a range from 30° to 40°.

28. The antenna according to claim 1, wherein a boundary section of the two fins has a length which lies within a range from 100 mm to 150 mm.

29. The antenna according to claim 25, wherein a third height of the fin with respect to the coupling or the decoupling apparatus lies within a range from 150 mm to 200 mm.

30. The antenna according to claim 1, wherein a height of the horn funnel lies within a range from 100 mm to 150 mm.

31. The antenna according to claim 1, wherein a distance of a folded edge for fastening the side walls of the horn funnel, from a base of each fin, lies within a range from 2 mm to 6 mm in each case.

* * * * *